US006420830B1

(12) United States Patent
Youn

(10) Patent No.: US 6,420,830 B1
(45) Date of Patent: Jul. 16, 2002

(54) PLASMA DISPLAY PANEL HAVING THREE DISCHARGE SUSTAIN ELECTRODES PER TWO PIXELS

(75) Inventor: Tae-Yong Youn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/235,746

(22) Filed: Jan. 25, 1999

(30) Foreign Application Priority Data

Jan. 26, 1998 (KR) ..... 98-2379

(51) Int. Cl.[7] ..... H01J 17/49
(52) U.S. Cl. ..... 313/586; 313/584; 313/583
(58) Field of Search ..... 313/581–604, 313/484–487; 345/60–68; 315/169.1, 169.3, 169.4

(56) References Cited

U.S. PATENT DOCUMENTS

| | | | | | |
|---|---|---|---|---|---|
| 4,190,788 | A | * | 2/1980 | Yoshikawa et al. | 315/169.4 |
| 4,276,492 | A | * | 6/1981 | Mayer | 313/188 |
| 5,369,338 | A | * | 11/1994 | Kim | 315/169.4 |
| 5,578,903 | A | * | 11/1996 | Pepi | 313/583 |
| 5,852,347 | A | * | 12/1998 | Marcotte | 315/169.4 |
| 5,952,782 | A | * | 9/1999 | Nanto et al. | 313/584 |
| 5,998,935 | A | * | 12/1999 | Marcotte | 315/169.4 |
| 6,031,329 | A | * | 2/2000 | Nagano | 313/582 |
| 6,072,449 | A | * | 6/2000 | Zmemiya | 345/67 |
| 6,097,149 | A | * | 8/2000 | Miyaji et al. | 313/582 |
| 6,118,214 | A | * | 9/2000 | Marcotte | 313/582 |
| 6,137,226 | A | * | 10/2000 | Nagano | 313/582 |
| 6,157,354 | A | * | 12/2000 | Amemiya | 345/60 |

FOREIGN PATENT DOCUMENTS

| | | | | |
|---|---|---|---|---|
| JP | 02220330 | A | 9/1990 | |
| JP | 05266800 | | 10/1993 | |
| JP | 09160525 | | 6/1997 | |
| JP | 410-255664 | A * | 3/1998 | 313/582 |
| JP | 410-255664 | * | 3/1998 | 313/582 |
| JP | 10247072 | | 9/1998 | |
| JP | 10283934 | | 10/1998 | |

* cited by examiner

*Primary Examiner*—Nimeshkumar D. Patel
*Assistant Examiner*—Karabi Guharay
(74) *Attorney, Agent, or Firm*—Fleshner & Kim, LLP

(57) ABSTRACT

Disclosed is a plasma display panel having two substrates coupled in parallel, each substrate comprising a plurality of electrodes, the respective electrodes on the two substrates crossing one another so as to form a plurality of pixels, the plasma display panel comprising: discharge sustain electrodes that one of the two substrates sustains discharge and that three electrodes are assigned per two pixels. Therefore, the electrode located at the center of the three discharge sustain electrodes can involve the discharge of adjacent pixels at each side through sustain discharge occurring between the center electrode and the adjacent electrodes at each side.

12 Claims, 5 Drawing Sheets

PLASMA DISPLAY PANEL HAVING THREE DISCHARGE SUSTAIN ELECTRODES PER TWO PIXELS

BACKGROUND OF THE INVENTION

1. Field of the Invention

The present invention relates to a plasma display panel (hereinafter, called "PDP") and more particularly to a PDP for minimizing the number of electrodes involving discharge in a discharge structure that pixels are formed at intersections of multiple electrodes, thereby improving luminance and resolution.

2. Description of Related Art

Typically, a PDP is a flat display device for displaying a dynamic or still picture using internal gas discharge phenomenon. According to the number of electrodes that are assigned to each pixel, the PDP is classified into a two-electrode type, a three-electrode type, and a four-electrode type. As for the two-electrode type, voltage for addressing and sustain is applied to two electrodes together. The three-electrode type is usually called a surface-discharge type. In the three-electrode type, switching or sustain is carried out by voltage applied to electrodes located on the sides of a discharge cell.

As a representative of such conventional PDP, the three-electrode surface-discharge PDP is illustrated in FIGS. 1 through 3.

FIG. 1 is an exploded, perspective view of the panel. FIG. 2 is a cross sectional view of a pixel. FIG. 3 shows disposition of electrodes. For helping readers to easily understand a discharge principal, an upper substrate is rotated at an angle of 90° in FIG. 2.

As shown in the drawings, the conventional three-electrode surface-discharge PDP includes front substrate 1 for displaying image and rear-substrate 2 forming a rear side that are spaced apart and arranged in parallel with each other.

On the front substrate 1 are formed discharge sustain electrodes (hereinafter, one is called a "common electrode (C)" and the other is called a "scan electrode (S)") paired in each pixel, for sustaining luminescence of a cell through mutual discharge therebetween. Each sustain electrode comprises transparent electrode 7 for preventing reduction of an aperture ratio and metal electrode 8 for reducing resistance of the transparent electrode 7. Dielectric layer 5 is formed to limit discharge current of the two electrodes and insulate pairs of electrodes against one another. On the dielectric layer 5 is formed protective layer 6.

The rear substrate 2 comprises: a plurality of walls 3 for partitioning a plurality of discharge spaces, namely, cells; a plurality of address electrodes A formed in parallel with the walls 3, for generating vacuum ultraviolet by carrying out address discharge at intersections where the address electrodes A and the scan electrodes S cross; and a phosphor 4 formed on inner surfaces of the both walls 3 making up each discharge cell and on the surface of the rear substrate 2, for producing visible rays for displaying images during the address discharge.

The following description concerns how a certain pixel emits light according to the conventional PDP having such configuration as described above.

Once a discharge start voltage is applied to a cell where the scan electrode S and the common electrode C are in a pair, surface discharge occurs between the two electrodes, so wall charge is accumulated on the inner surfaces of the corresponding discharge space.

Afterward, if an address discharge voltage is applied to the scan electrode S and a corresponding address electrode A, writing discharge occurs within the cell. Then, if a sustain discharge voltage is applied to the scan electrode S and the common electrode C, sustain discharge is caused by charged particles produced during the address discharge occurring between the address electrode A and the scan electrode S so that luminescence of the cell can be sustained during a certain period.

In other words, an electric field is formed within the cell by the discharge occurring between the electrodes. The electric field is formed when electrons in the discharge gas are accelerated and collide with neutrons. Collision of the electrons and neutrons causes the neutrons to be ionized at gently rising speed producing electrons and ions, and therefore, the discharge gas turns into plasma and vacuum ultraviolet are generated. The ultraviolet excites the phosphor 4 so as to generate visible rays. The visible rays are sent out through the front substrate 1, so the luminescence of the corresponding cell, namely, image display can be recognized as viewed from the outside.

In such image display operation, a luminance characteristic and luminous efficacy depends on the amount of the visible rays that have been sent out. The amount of the visible rays sent out depends on various factors.

If the other factors including the luminous characteristic of the phosphor are the same, the amount of the visible rays depends on the aperture ratio of the pixel, namely, spacing between the metal electrodes 7 on the respective scan electrode S and common electrode C. As the spacing (aperture ratio) gets greater, the luminance characteristic and luminous efficacy gets better.

In such configuration of the conventional panel as described above, pixels are discriminated by the discharge sustain electrode group where the scan electrode S and the common electrode C are in a pair and the mutual discharge between the sustain electrodes disposed within the pixel is essentially required to sustain the luminescence.

Consequently, the spacing between the metal electrodes 8 is limited by the maximum spacing between the scan electrode S and the common electrode C disposed within the pixel, so there is a limit to improvement in the luminance characteristic and the luminous efficacy through increase of the aperture ratio, which corresponds to the spacing between the metal electrodes 8, in the conventional art.

SUMMARY OF THE INVENTION

Accordingly, the present invention is directed to a plasma display panel that substantially obviates one or more of the limitations and disadvantages of the related art.

An objective of the present invention is to provide a plasma display panel (PDP) for allowing increase of an aperture ratio of a pixel by minimizing the number of discharge sustain electrodes disposed on a front substrate that is a surface on which images displayed outwardly, thereby improving a luminance characteristic of the PDP and improving resolution of the PDP through realization of high definition.

Additional features and advantages of the invention will be set forth in the following description, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, a plasma display panel having two substrates coupled in parallel, each substrate comprising a plurality of electrodes, the respective electrodes on the two substrates crossing one another so as to form a plurality of pixels, the plasma display panel comprises: discharge sustain electrodes that one of the two substrates sustains discharge and that three electrodes are assigned per two pixels.

At least one of the assigned three discharge sustain electrodes comprises a transparent electrode and a metal electrode.

Two electrodes respectively located at each side among the three discharge sustain electrodes assigned per two pixels are metal electrodes.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

Figure 4A:
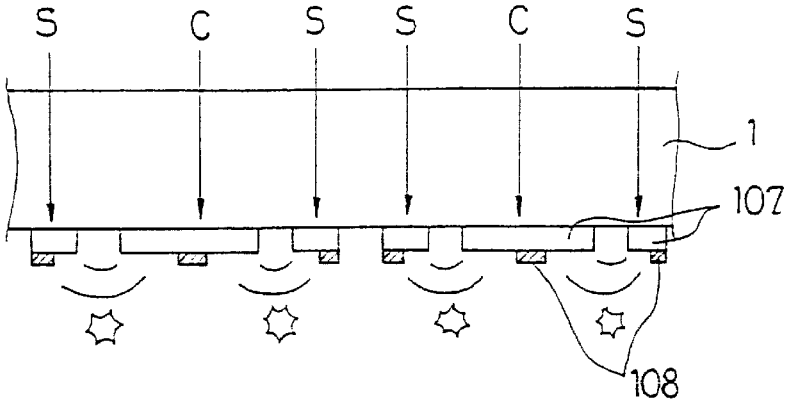
Figure 4B:
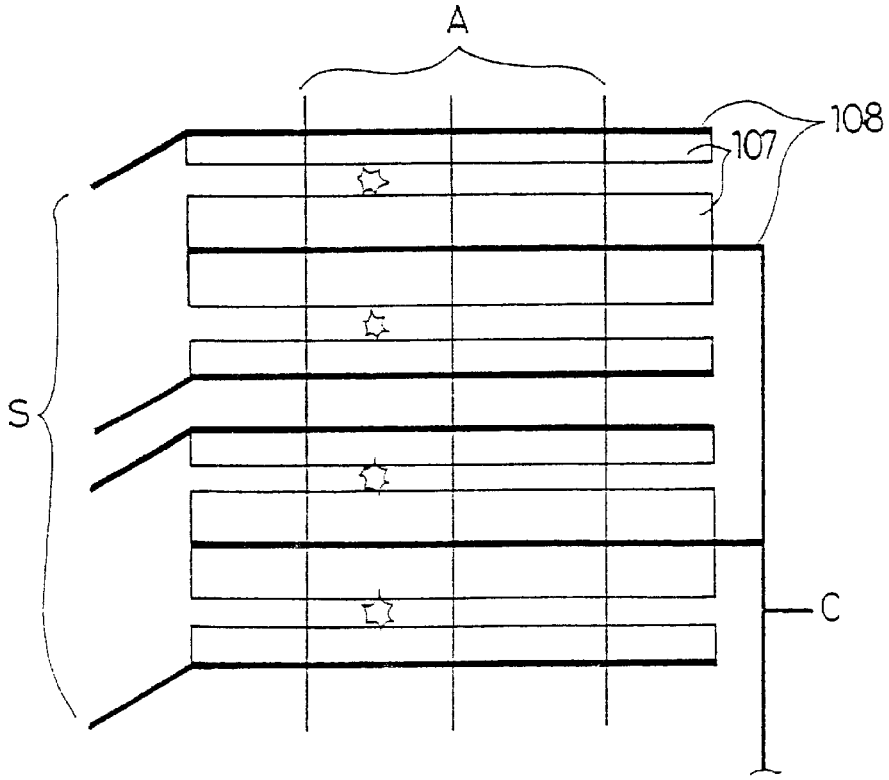
Figure 5A:
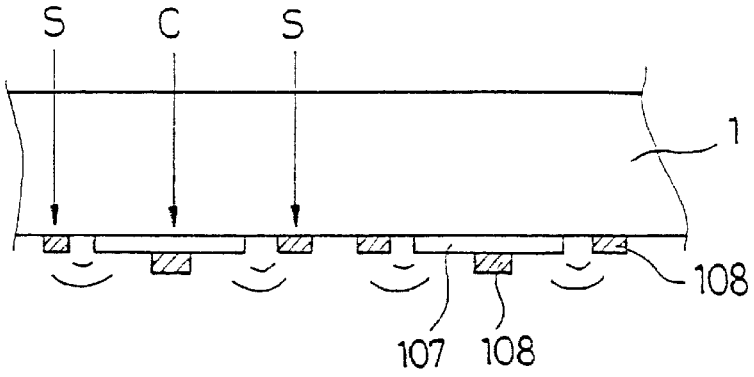
Figure 5B:
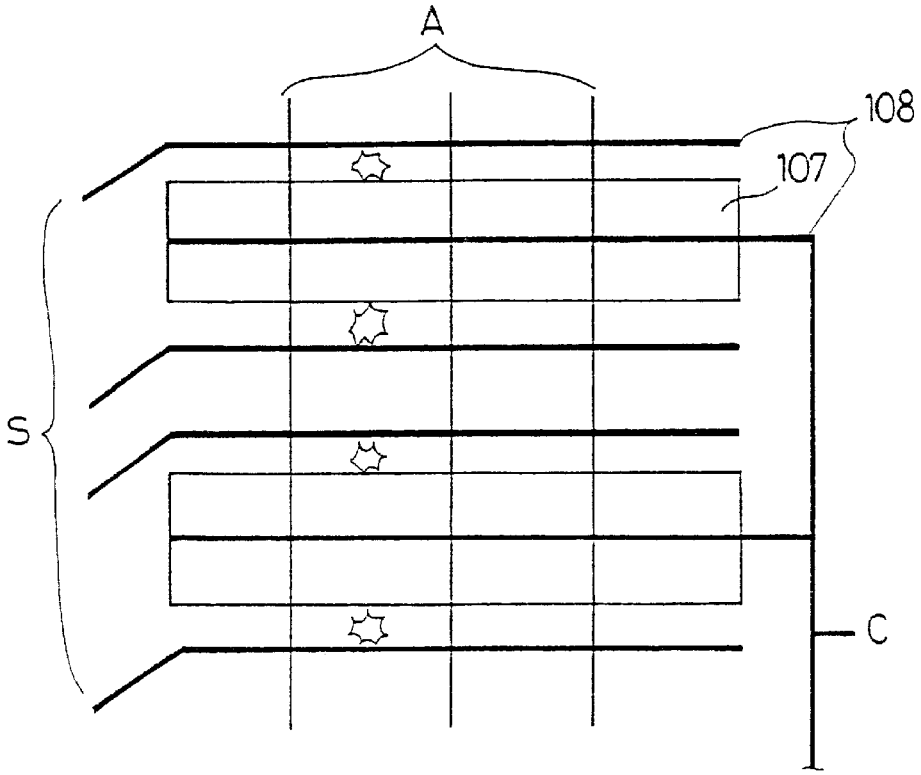

FIG. 4*a* is a cross sectional view showing disposition of discharge sustain electrodes according to a first embodiment of the present invention;

FIG. 4*b* shows disposition of the discharge sustain electrodes according to the first embodiment of the present invention;

FIG. 5*a* is a cross sectional view showing disposition of discharge sustain electrodes according to a second embodiment of the present invention; and FIG. 5*b* shows disposition of the discharge sustain electrodes according to the second embodiment of the present invention.

DETAILED DESCRIPTION OF PREFERRED EMBODIMENT

Reference will now be made in detail to the preferred embodiments of the present invention, examples of which are illustrated in the accompanying drawings.

With reference to the accompanying drawings, the present invention will now be described in detail. In the description on the present invention, the same reference characters are given to the same elements as in the conventional art and description on the same elements will be omitted.

FIGS. 4*a* and 4*b* show the configuration of discharge sustain electrodes in a PDP according to one embodiment of the present invention.

As for discharge sustain electrodes C and S according to the embodiment of the present invention having the front substrate 1 on which a plurality of pixels are formed, three electrodes are assigned per two pixels. The three electrodes consist of the address electrode A and the scan electrode S for producing writing discharge, the both electrodes being separately located at two sides, and the common electrode C for sustain discharge, located at a center between the address electrode A and the scan electrode S.

Each sustain electrode comprises transparent electrode 107 and metal electrode 108. The metal electrode 108 is located at the center corresponding to a boundary between pixels on the common electrode C to minimize reduction of the aperture ratio caused by the metal electrode 108.

In such configuration, once an address discharge voltage is applied to the scan electrode S and the corresponding address electrode A, mutual writing discharge causes a corresponding cell to emit light. Afterward, a sustain discharge voltage is applied to the scan electrode and the corresponding common electrode C, mutual sustain discharge occurs, thereby allowing luminescence of the pixel to be sustained during a certain period.

Such common electrode C as described above involves the sustain discharge of adjacent pixels at each side thereof in common, so the sustain discharge for two pixels can be controlled with one common electrode C and two scan electrodes S.

In another embodiment as shown in FIGS. 5*a* and 5*b*, the scan electrode S among the three assigned sustain electrodes is composed of only the metal electrode 108 having relatively lower resistance, thus preventing even very small decrease in transmission that is caused by the transparent electrode.

According to the two manners of arranging the electrodes offered by the two embodiments in accordance with the present invention, the number of discharge sustain electrodes on the front substrate 1, which is a surface for displaying images, can be minimized, thereby realizing advantageous formation of a unit pixel, improving the luminance, and facilitating realization of the high resolution.

Figure 1:
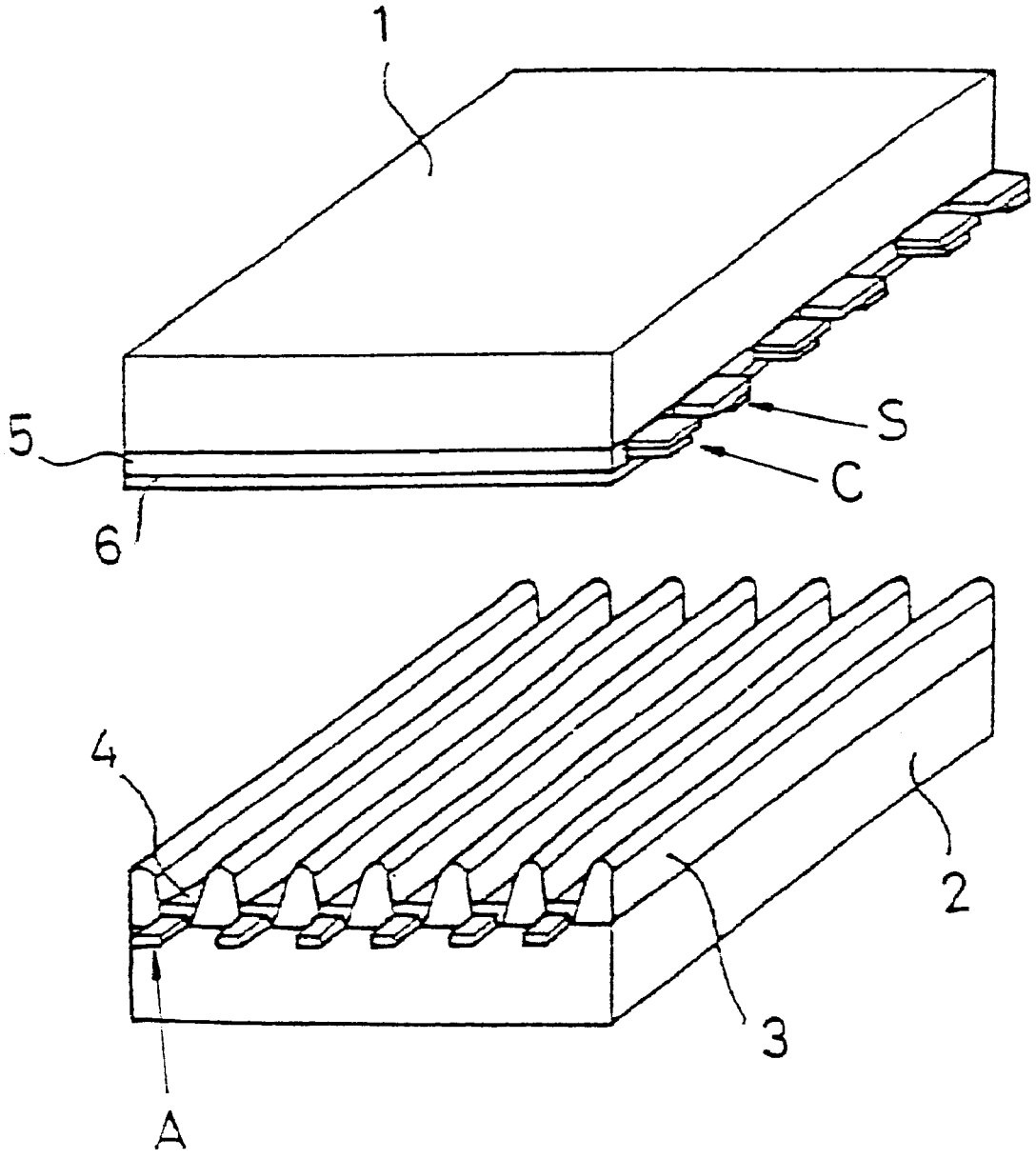
Fig. 1 Related Art
FIG. 1 is an exploded, perspective view of a conventional three-electrode surface-discharge PDP.
Figure 2:
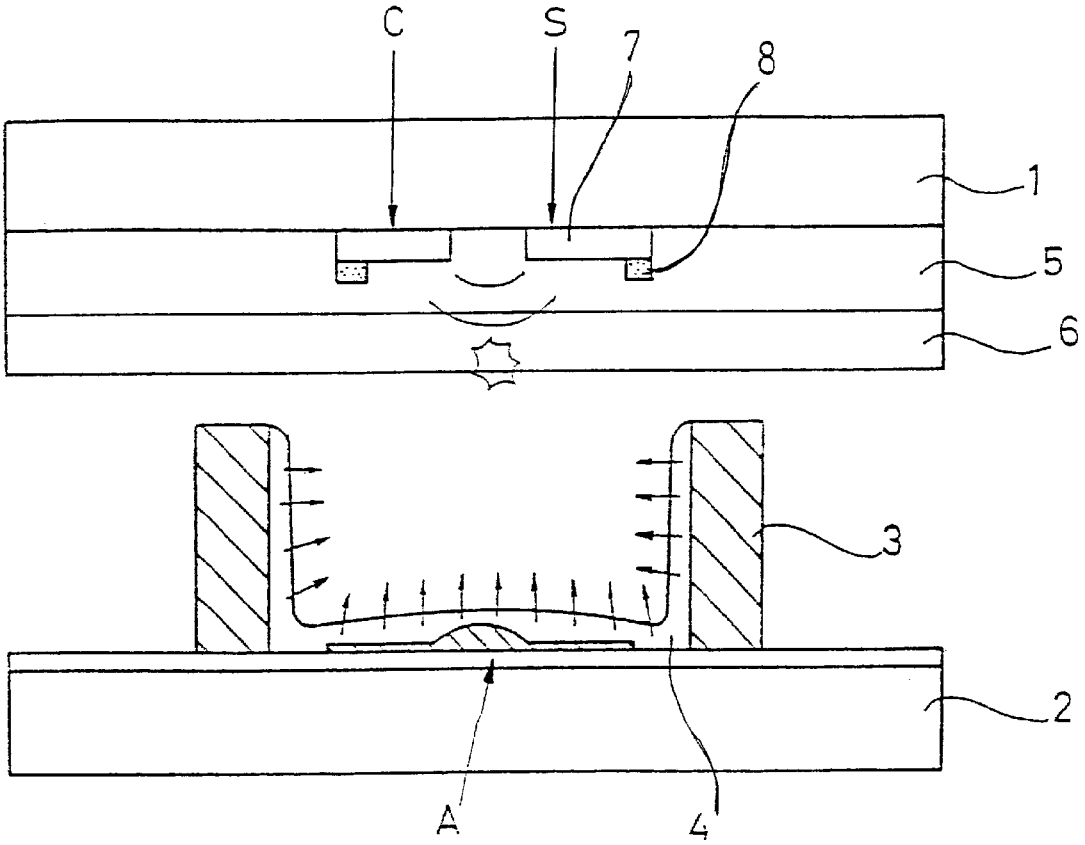
Fig. 2 Related Art
FIG. 2 is a cross sectional view showing a configuration of a pixel according to the conventional PDP.
Figure 3:
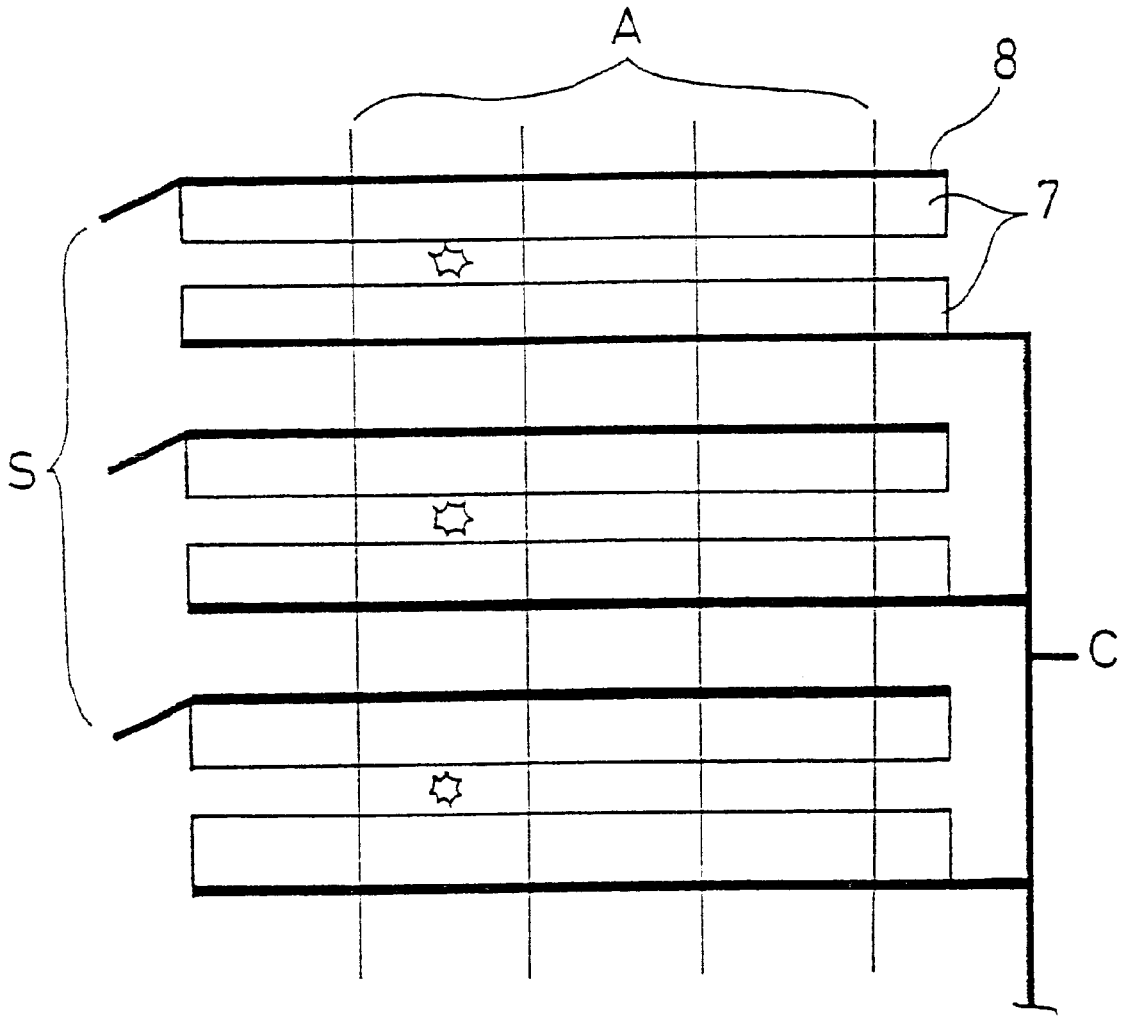
Fig. 3 Related Art
FIG. 3 shows disposition of electrodes according to the conventional PDP.

When comparing the disposition of the discharge sustain electrodes in a PDP according to the conventional art as shown in FIG. 3 with the dispositions of the discharge sustain electrodes in a PDP according to the present invention as shown in FIGS. 4*b* and 5*b*, two sustain electrodes involve the discharge of one pixel in the conventional art while three sustain electrodes involve the discharge of two pixels in the present invention.

Therefore, in aspect of a structural feature, the aperture ratio of a pixel in the present invention is higher than the aperture ratio of a pixel in the conventional art, so the amount of visible rays sent out is increased in the present invention, thereby improving the luminance characteristic and the luminous efficacy.

In addition, more pixels can be formed with the same number of sustain electrodes in the present invention, thereby enhancing resolution through realization of high definition.

As illustrated, the present invention has advantages in the luminance characteristic and the realization of high definition picture and, moreover, sharply decreases the number of necessary, discharge sustain electrodes, thereby simplifying the configuration of the panel.

It will be apparent to those skilled in the art that various modifications and variations can be made in the plasma display panel of the present invention without deviating from the spirit or scope of the invention. Thus, it is intended that the present invention covers the modifications and variations of this invention provided they come within the scope of the appended claims and their equivalents.

What is claimed is:

1. A plasma display panel comprising:

two substrates coupled in parallel, wherein each said substrate comprises a plurality of electrodes, wherein said electrodes on each of said substrates cross one another to form a plurality of pixels; and discharge sustain electrodes, wherein one of said two substrates comprises discharge sustain electrodes, and wherein three discharge sustain electrodes are assigned per two of the plurality of pixels.

2. A plasma display panel according to claim 1, wherein at least one of said three discharge sustain electrodes assigned per two of the plurality of pixels comprises a transparent electrode and a metal electrode on said transparent electrode.

3. A plasma display panel according to claim 2, wherein two discharge sustain electrodes located at each side of a third discharge sustain electrode, which is central to said three discharge sustain electrodes assigned per two pixels, are metal electrodes.

4. A plasma display panel according to claim 1, wherein a discharge sustain electrode located at a center of said assigned three discharge electrodes is coupled to adjacent discharge sustain electrodes located at each center of other three discharge electrode groups.

5. A plasma display panel according to claim 1, wherein two discharge sustain electrodes located at each side of a third discharge sustain electrode, which is central to said three discharge sustain electrodes assigned per two pixels, are metal electrodes.

6. A plasma display panel according to claim 1, wherein said three discharge sustain electrodes assigned per two of the plurality of pixels comprise:

a common electrode, and two scan electrodes, wherein the common electrode is parallel to the two scan electrodes and wherein the common electrode is located between the two scan electrodes.

7. A plasma display panel according to claim 1, wherein said three discharge sustain electrodes assigned per two of the plurality of pixels comprise:

a common electrode comprising a metal electrode centered on a transparent electrode; and two scan electrodes each comprising a metal electrode and a transparent electrode, wherein the metal electrode is aligned with an edge of the transparent electrode, wherein the edge is the edge furthest from the common electrode.

8. A plasma display panel according to claim 1, wherein the three discharge sustain electrodes assigned per two of the plurality of pixels comprise:

a common electrode, wherein the common electrode is electrically connected to an adjacent common electrode two pixels away in a direction orthogonal from the length of the common electrode, and two scan electrodes, wherein each of the two scan electrodes are adjacent to the common electrode and a third scan electrode from an adjacent pixel, wherein the adjacent pixel is not part of the two pixels that the three discharge sustain electrodes are assigned.

9. A plasma display panel comprising:

a front substrate;

a rear substrate parallel to said front substrate;

a dielectric layer on said front substrate;

a plurality of address electrodes on said rear substrate;

a plurality of discharge sustain electrodes on said front substrate, wherein the plurality of address electrodes and plurality of discharge sustain electrodes are perpendicular to one another and cross each other to form pixels, wherein three discharge sustain electrodes are assigned per two pixels, and wherein the three discharge sustain electrodes assigned per two pixels comprise a common electrode comprising a transparent electrode on said front substrate and a metal electrode on the transparent electrode, and two scan electrodes comprising metal electrodes on said front substrate.

10. A plasma display panel according to claim 9, wherein the common electrode assigned per two pixels is parallel to the two scan electrodes and wherein the common electrode is located between the two scan electrodes for each three discharge electrodes assigned per two of the plurality of pixels.

11. A plasma display panel according to claim 9, wherein each common electrode assigned per two pixels is electrically connected to an adjacent common electrode two pixels away in a direction orthogonal from the length of the common electrode, and two scan electrodes, wherein each scan electrode is adjacent to the common electrode assigned per two pixels and a third scan electrode from an adjacent pixel, wherein the adjacent pixel is not part of the two pixels that the three discharge sustain electrodes are assigned.

12. A plasma display panel according to claim 9, wherein the metal electrodes of the two scan electrodes have lower resistances than the transparent electrode of the common electrode and thus prevents small decreases in transmission.

* * * * *